US009017192B1

(12) United States Patent
Silva

(10) Patent No.: US 9,017,192 B1
(45) Date of Patent: Apr. 28, 2015

(54) ATHLETIC TRAINING DEVICE

(71) Applicant: Roberto Silva, Farmingville, NY (US)

(72) Inventor: Roberto Silva, Farmingville, NY (US)

( * ) Notice: Subject to any disclaimer, the term of this patent is extended or adjusted under 35 U.S.C. 154(b) by 0 days.

(21) Appl. No.: 13/757,874

(22) Filed: Feb. 4, 2013

Related U.S. Application Data

(60) Provisional application No. 61/633,249, filed on Feb. 8, 2012.

(51) Int. Cl.
*A63B 43/04* (2006.01)
*A63B 41/00* (2006.01)

(52) U.S. Cl.
CPC ..... *A63B 41/00* (2013.01)

(58) Field of Classification Search
CPC ..... A63B 41/00; A63B 43/00; A63B 43/04; A63B 43/002; A63B 2041/005
USPC ..... 473/594, 595, 603–605
See application file for complete search history.

(56) References Cited

U.S. PATENT DOCUMENTS

| | | | | | |
|---|---|---|---|---|---|
| 2,524,546 | A * | 10/1950 | Sinclaire | 473/570 |
| 3,655,197 | A * | 4/1972 | Milbaum | 273/146 |
| 3,980,300 | A * | 9/1976 | Hornsby, Jr. | 473/594 |
| 4,872,676 | A * | 10/1989 | Townsend | 473/413 |
| 4,917,381 | A * | 4/1990 | Spector | 473/594 |
| 4,986,540 | A * | 1/1991 | Leslie | 473/594 |
| 5,070,610 | A * | 12/1991 | Leslie | 29/899.1 |
| 5,413,331 | A * | 5/1995 | Stillinger | 473/599 |
| 5,577,723 | A * | 11/1996 | DiResta et al. | 473/571 |
| 5,722,906 | A * | 3/1998 | Gentile | 473/471 |
| 6,056,622 | A * | 5/2000 | Chung | 446/435 |
| 6,514,164 | B1 * | 2/2003 | Parrett | 473/603 |
| 6,572,499 | B2 | 6/2003 | Davies | |
| 6,793,597 | B2 * | 9/2004 | Awan | 473/605 |
| 7,026,399 | B2 | 4/2006 | Kim et al. | |
| 2011/0015010 | A1 * | 1/2011 | Forrest, Sr. | 473/594 |

* cited by examiner

*Primary Examiner* — Steven Wong
(74) *Attorney, Agent, or Firm* — Emery L. Tracy; Ruth Eure

(57) ABSTRACT

An athletic training device for training athletes is provided. The athletic training device comprises a training ball having an outer cover and an inner air bladder. A predetermined amount of silicon is positioned between the outer cover and the inner air bladder wherein the silicon covers a least a portion of the inner air bladder.

10 Claims, 1 Drawing Sheet

ATHLETIC TRAINING DEVICE

The present application claims the benefit of priority of provisional patent application Ser. No. 61/633,249, filed on Feb. 8, 2012, entitled "Training Ball".

BACKGROUND OF THE INVENTION

1. Field of the Invention

This invention relates generally to an athletic training device and, more particularly, the invention relates to an athletic training device having a layer of silicone injected between an outer cover and an inner air bladder.

2. Description of the Prior Art

Soccer is unique in a number of respects, the most notable of which is that when the ball is in play, no one but the goalie can touch it with his or her hands. But it differs also in that regardless of their position, all 22 players on the field must develop, and use, a wide variety of individual skills. Every player must develop the ability to run fast and for a long time; to stop, start, and change direction in an instant; to anticipate the flight and movement of the ball; and, in general, to move fast and react quickly. Anything that helps to develop, refine, teach, and hone these skills and abilities will produce a better player whether that player is a middle-school student, a boy or girl, a young man in a recreational league, or a pro.

SUMMARY

The present invention is an athletic training device for training athletes. The athletic training device comprises a training ball having an outer cover and an inner air bladder. A predetermined amount of silicone is positioned between the outer cover and the inner air bladder wherein the silicone covers a least a portion of the inner air bladder.

In addition, the present invention includes a method for training athletes. The method comprises providing a training ball having an outer cover and an inner air bladder, positioning a predetermined amount of silicone between the outer cover and the inner air bladder, and covering at a least a portion of the inner air bladder with the silicone.

DETAILED DESCRIPTION OF THE PREFERRED EMBODIMENTS

Figure 1:
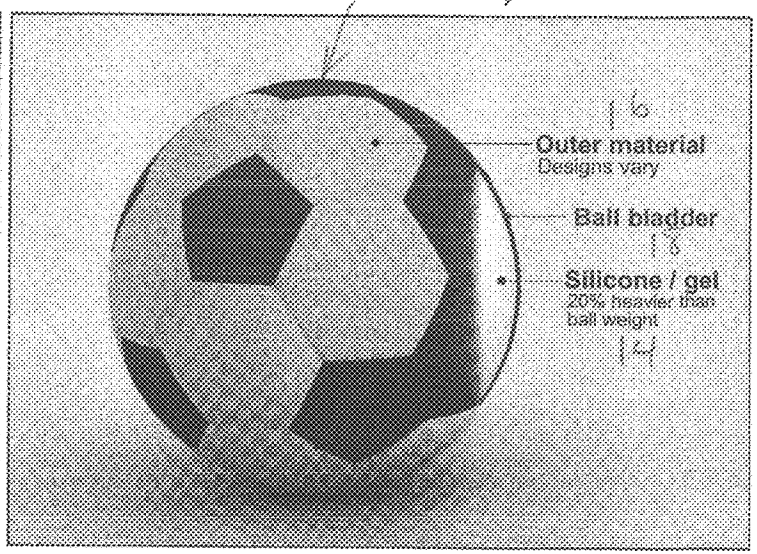
FIG. 1 is a perspective view illustrating an athletic training device, constructed in accordance with the present invention, with a silicon layer positioned between an outer cover and an inner air bladder.
Figure 2:
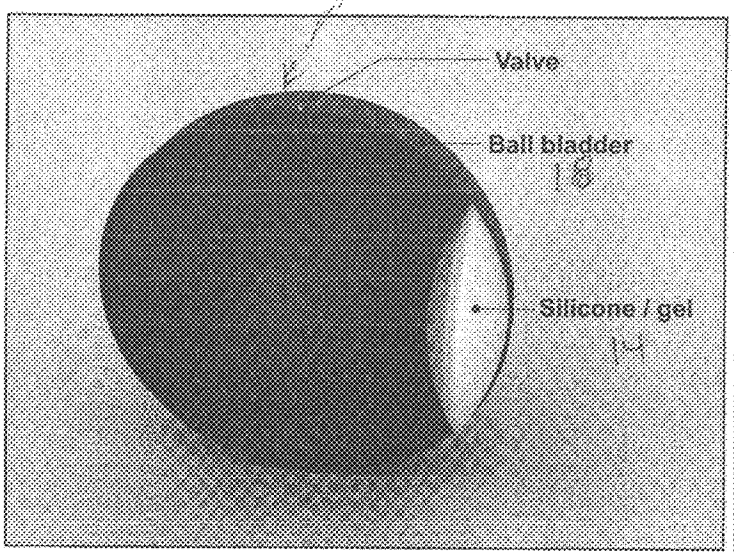
FIG. 2 is a perspective view illustrating the athletic training device, constructed in accordance with the present invention, with the outer cover removed.

As illustrated in FIGS. 1 and 2, the present invention is an athletic training device, indicated generally at 10, providing a training ball 12 having a layer of silicone 14 positioned or injected between an outer cover 16 and an inner air bladder 18. In a preferred embodiment, the training ball 12 of the athletic training device 10 of the present invention can be produced in two basic varieties or versions.

The first version of the training ball 12 of the athletic training device 10 of the present invention injects about four (4 oz.) ounces of a silicone material 14 under the outer cover 16 such that the injected silicone layer 14 covers only a portion of the inner air bladder 18. In other words, the silicone layer 14 is positioned on one side of the training ball 12 but not the other resulting in a slightly heavier training ball 12 that moves faster, but moves erratically due to the off-balance weight distribution. The off-balance weight distribution of the training ball 12 makes the training ball 12 more difficult to anticipate or control, and forces the player to reverse direction more quickly and more frequently. The training ball 12 of the first version of the athletic training device 10 requires more refined skills on the part of the player(s) practicing with it, and thus helps to develop those skills. A production version of the training ball 12 incorporates the partial silicone layer it into the manufacture of the athletic training device 10 for soccer players of all ages and levels.

In an embodiment of the first version of the training ball 12 of the athletic training device 10 of the present invention, the silicone 14 can cover less than one-half of the inner bladder 18. In another embodiment, the silicone 14 can cover more than one-half of the inner air bladder 18. The amount of silicone 14 actually positioned between the outer cover 16 and the inner air bladder 18 is dependent on the amount of weight and off-balance desired by the manufacturer, coach, and/or player. Additional silicone 14 can be injected or removed at the point of play depending on the desires of the training coordinator.

A second version of the training ball 12 of the athletic training device 10 of the present invention features a complete, evenly applied, spherical layer of silicone 14 between the outer cover 16 of the training ball 12 and the inner air bladder 18 of the training ball 12. In this version of the training ball 12 of the athletic training device 10, the training ball 12 is heavier and faster, just as the initial version was, but also moves, flies, rolls, and bounces in a "true" manner.

Among the advantages of the training ball of the athletic training device 10 of the present invention are its benefits in developing greater foot speed and agility in soccer players of all ages and levels, as well as promoting a keener sense of anticipation with regard to the movement of the training ball 12. Further, because the production of the training ball 12 involves a relatively simple intermediate step in the production process, i.e., the injection of the silicone layer 14 between the outer cover 16 and inner air bladder 18 of the training ball 12, it is possible to produce the training ball at a relatively minimal cost with the "raw material" being any soccer ball constructed with an outer cover 16 and an interior air bladder 18. The prospect of offering two alternative, broadly similar but slightly different versions of the training ball 12 is another advantage in terms of marketing. Given the popularity of soccer, both within the United States and around the world, the market for the athletic training device 10 is virtually unlimited, and soccer players of all ages and levels, as well as their coaches and parents.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. An athletic training device for training athletes, the athletic training device comprising:

a training ball having an outer cover and an inner air bladder; and a predetermined amount of silicone positioned between the outer cover and the inner air bladder; wherein the silicone covers only a portion of the inner air bladder with a remaining area of the inner air bladder being free from silicone coverage wherein the ball moves erratically due to off-balance weight distribution created by the silicone positioned between the outer cover and the inner air bladder.

2. The athletic training device of claim 1 wherein the silicone covers less than one-half of the inner air bladder.

3. The athletic training device of claim 1 wherein the silicone covers more than one-half of the inner air bladder.

4. The athletic training device of claim 1 wherein the silicone is injected under the outer cover above the inner air bladder.

5. The athletic training device of claim 1 wherein the silicone is positioned upon the inner air bladder prior to covering the inner air bladder with the outer cover.

6. A method for training athletes, the method comprising: providing a training ball having an outer cover and an inner air bladder; positioning a predetermined amount of silicone between the outer cover and the inner air bladder; and covering only a portion of the inner air bladder with the silicone with a remaining area of the inner air bladder being free from silicone coverage, wherein the ball moves erratically due to off-balance weight distribution created by the silicone positioned between the outer cover and the inner air bladder.

7. The method of claim 6 and further comprising:

covering less than one-half of the inner air bladder with the silicone.

8. The method of claim 6 and further comprising:

covering more than one-half of the inner air bladder with the silicone.

9. The method of claim 6 and further comprising: injecting the silicone under the outer cover above the inner air bladder.

10. The method of claim 6 and further comprising: positioning the silicone upon the inner air bladder prior to covering the inner air bladder with the outer cover.

* * * * *